US011118488B2

(12) United States Patent
Mueller

(10) Patent No.: US 11,118,488 B2
(45) Date of Patent: Sep. 14, 2021

(54) ACTUATING DEVICE FOR A CAMSHAFT TIMING APPARATUS

(71) Applicant: HELLA GMBH & CO. KGAA, Lippstadt (DE)

(72) Inventor: Hagen Mueller, Bad Wuennenberg (DE)

(73) Assignee: Hella GmbH & Co. KGaA, Lippstadt (DE)

( * ) Notice: Subject to any disclaimer, the term of this patent is extended or adjusted under 35 U.S.C. 154(b) by 0 days.

(21) Appl. No.: 16/919,962

(22) Filed: Jul. 2, 2020

(65) Prior Publication Data

US 2020/0355097 A1 Nov. 12, 2020

Related U.S. Application Data

(63) Continuation of application No. PCT/EP2018/050034, filed on Jan. 2, 2018.

(51) Int. Cl.
*F01L 1/34* (2006.01)
*F01L 1/344* (2006.01)

(52) U.S. Cl.
CPC ... *F01L 1/3442* (2013.01); *F01L 2001/34426* (2013.01)

(58) Field of Classification Search
CPC ..... F01L 1/3442; F01L 2001/34426; F01L 2001/3443; F01L 2250/02; F01L 2250/06; F01L 2301/00
See application file for complete search history.

(56) References Cited

U.S. PATENT DOCUMENTS

| | | | | |
|---|---|---|---|---|
| 6,622,677 | B2 * | 9/2003 | Simpson | F01L 1/352 123/90.15 |
| 7,182,053 | B2 | 2/2007 | Meintschel et al. | |
| 8,011,337 | B2 | 9/2011 | Hayashi | |
| 8,434,439 | B2 | 5/2013 | Richter et al. | |
| 8,689,749 | B2 | 4/2014 | Suzuki et al. | |
| 2008/0153603 | A1 | 6/2008 | Gregor et al. | |
| 2009/0120388 | A1 | 5/2009 | Lee et al. | |

FOREIGN PATENT DOCUMENTS

| | | | |
|---|---|---|---|
| DE | 103 26 886 | A1 | 12/2004 |
| DE | 10 2005 028 313 | A1 | 12/2006 |
| DE | 10 2008 055 191 | A1 | 7/2009 |
| DE | 10 2008 060 927 | A1 | 6/2010 |
| DE | 10 2009 026 626 | A1 | 12/2010 |
| DE | 10 2012 221 474 | A1 | 5/2013 |

* cited by examiner

*Primary Examiner* — Zelalem Eshete
(74) *Attorney, Agent, or Firm* — Muncy, Geissler, Olds & Lowe, P.C.

(57) ABSTRACT

An actuating device for a camshaft timing apparatus, having a movable actuating member being supported displaceable along a translational axis, and a force generator for generating a force driving the actuating member along the translational axis, wherein the actuating member is supported rotatable about a rotational axis and wherein the actuating device comprises a torque generator for subjecting the actuating member to a torque about the rotational axis.

11 Claims, 3 Drawing Sheets

ACTUATING DEVICE FOR A CAMSHAFT TIMING APPARATUS

This nonprovisional application is a continuation of International Application No. PCT/EP2018/050034, which was filed on Jan. 2, 2018, and which is herein incorporated by reference.

BACKGROUND OF THE INVENTION

Field of the Invention

The present invention relates to an actuating device for a camshaft timing apparatus. The actuating device comprises a movable actuating member which is supported displaceable along a translational axis and has a force generator for generating a force which drives the actuating member along the translational axis. The invention further relates to a method for operating an actuating device, a system comprising a camshaft timing apparatus and an actuating device and a method for operating the system.

Description of the Background Art

Apparatuses for camshaft timing adjustment, which can be referred to as camshaft timing apparatuses, are widely used for controlling an angular relation between a rotatable camshaft and a rotatable crankshaft of an engine, particularly a car engine. In most cases a transmission between the camshaft and the crankshaft is configured for rotating the camshaft at half the angular speed of the crankshaft.

While each angular position of the crankshaft corresponds to defined lifting positions of cylinder pistons of the engine, each angular position of the camshaft corresponds to defined opening/closing states of cylinder valves of the engine. Opening and closing times of the cylinder valves substantially affect both the performance and the efficiency, i.e. the driving power and the fuel consumption of the engine.

The most performant and/or efficient opening and closing times of the cylinder valves depend on an actual load and a rotational speed of the engine. Therefore, during operation of the engine an adaptive adjustment of the angular relation between the camshaft and the crankshaft is preferred for sake of optimization. This optimization is usually achieved by means of a camshaft timing apparatus which preferably continuously controls the angular relation between the camshaft and the crankshaft.

Some camshaft timing apparatus are torque-proof coupled to both the camshaft and the crankshaft of the engine. They comprise a hydraulic motor for adjusting the angular position of the camshaft relative to the angular position of the crankshaft. The hydraulic motor, thus, is part of the transmission between the crankshaft and the camshaft and allows for applying a torque to the camshaft relative to the crankshaft to thereby rotate the camshaft relative to the crankshaft. The relative rotation results in advancing or retarding the opening/closing states of the engine valves, respectively, relative to the lifting positions of the cylinder pistons.

The hydraulic motor is operated by means of a hydraulic fluid which is provided to the hydraulic motor by a hydraulic pump. The hydraulic pump usually comprises a stator and a rotor being rotatable relative to the stator. The rotor is configured to pump the hydraulic fluid from a first port to a second port of the hydraulic pump when the hydraulic pump is operated, thus generating a pressure gradient between the first port and the second port. It is to be understood, that the terms stator and rotor do not have any absolute meaning as they naturally depend on a chosen reference frame. Hereinafter, the term rotor simply indicates the component of the hydraulic pump which has shovels, blades or the like for advancing the hydraulic fluid.

Both the first port and the second port of the hydraulic pump are connected to the hydraulic motor of the camshaft timing apparatus via a valve. The valve is configured to control the fluid connection between the hydraulic pump and the hydraulic motor and in most cases has three valve states. In a first valve state a fluid connection is established for setting ahead the camshaft relative to the crankshaft. In a second valve state a fluid connection is established for setting back the camshaft relative to the crankshaft. In a third valve state no fluid connection is established thus keeping the angular relation between the camshaft and the crankshaft constant.

The valve usually comprises a valve actuator having three positions corresponding to three valve states, e.g. the actuator may be displaceable along a translational axis and can be moved back and forth between three axial positions corresponding to the three valve states. The displacement of the valve actuator may be provided by a corresponding actuating device coupled to the valve actuator. The actuating device may correspondingly comprise a movable actuating member being supported displaceable e.g. along the translational axis and connected to the valve actuator and a force generator for generating a force driving the actuating member e.g. along the translational axis.

An advanced camshaft timing apparatus may integrate the hydraulic motor and the hydraulic pump. In that case the rotor of the hydraulic pump may be fixed to a stationary part of the engine by a torque generator while the stator of the hydraulic pump is torque-proof connected to the camshaft. Thus, a relative rotation of the rotor and the stator is provided when the engine is running and the camshaft is rotating. Operating the hydraulic pump by the camshaft is advantageous for economic, structural and dimensional reasons as a separate additional drive for the hydraulic pump can be avoided.

In this configuration the hydraulic pump must operate at all times without any interruption during operation of the engine. As a consequence, a pressure gradient between the first port and the second port of the pump is generated even if no operation of the hydraulic motor, i.e. no camshaft timing adjustment is required. Another consequence is that the generated pressure gradient is exclusively determined by the actual angular speed of the camshaft at any time and, thus, is excluded from any independent adaption. Both aspects cause an energy loss which noticeably reduces the driving power and the efficiency of the engine.

SUMMARY OF THE INVENTION

It is therefore an object of the present invention to provide an actuating device for a camshaft timing apparatus of the aforementioned type which increases the driving power and the efficiency of the engine.

An actuating device for a camshaft timing apparatus according to an exemplary embodiment of the invention may comprise a movable actuating member being supported displaceable along a translational axis. The actuating member may be configured for being tension-proof and thrust-proof connected to a valve actuator of the camshaft timing apparatus allowing for a mechanical coupling (e.g a rigid or an elastic coupling) of the actuating device to the camshaft timing apparatus.

Furthermore, the actuating device may comprise a force generator for generating a force driving the actuating member along the translational axis. Thus, the force generator may provide a linear displacement of the actuating member and a valve actuator coupled thereto.

Preferably, the actuating member is supported rotatable about a rotational axis. In other words, the actuating member has an additional degree of freedom. The actuating device preferably comprises a torque generator for subjecting the actuating member to a torque about the rotational axis. The torque generator, thus, allows for controlling the rotation of the actuating member applying a torque to the rotating actuating member.

The actuating member may comprise a shaft extending along the translational axis. The shaft may have an elongate shape and may preferably comprise or be a cylindrical rod. For example the shaft may comprise at least a section having the shape of a cylindrical rod.

Preferably, the actuating member comprises a protrusion extending transverse to the shaft and being tension-proof and thrust-proof connected to the shaft. The protrusion may be positioned between opposite axial free ends of the shaft, particularly it may be positioned axially eccentric thus dividing the shaft into a shorter section and a longer section. For instance, the protrusion may be a disc being formed integral with the shaft. The disc may have a circular plate-like shape and be disposed concentric with the cylindric rod.

The actuating device may comprise at least one end stop being axially fixed and defining an axial position of the protrusion abutting the at least one end stop. The at least one end stop may comprise annular disc facing the protrusion and having a bore which the shaft of the actuating member extends through. Again, a circular shape of the disc and a central cylindric bore are preferred for sake of a rotationally symmetric structure of the actuating device, but not required. Particularly, the radial lengths of the disc-like protrusion and the disc-like end stop may be at least substantially equal, e.g. differ by less than 25%, preferably by less than 10% or even more preferred by less than 5% of the radial length of the protrusion at most.

The actuating device preferably comprises two end stops being arranged at a distance from with the protrusion in between. The two end stops are thus at opposite sides of the protrusion and define a first axial position and a second axial position of the protrusion. In other words, the distance of the end stops defines a maximum of an axial stroke of the actuating member. The distance may be preferably chosen corresponding to a distance between a first axial position and a second axial position of a valve actuator of the camshaft timing apparatus.

The actuating device may further comprise a restorer for restoring an axial position of the protrusion between the end stops thus defining a third axial position of the protrusion between the first axial position and the second axial position. The restorer may comprise at least one spring applying a restoring force to the actuating member in case the protrusion is located at a distance from the third position, the restoring force being directed to the third axial position. Preferably, the third position is defined central, i.e. half way between the first position and the second position.

The torque generator may be axially fixed and the protrusion may be torque-proof connected to the shaft wherein the torque generator and the protrusion preferably each comprise an axial face. The axial faces face each other and provide a rotational resistance to the protrusion abutting the torque generator if forced against each other. The rotational resistance may be increased by at least one friction pad or the like, the at least one friction pad being mounted to or being integrated in any axial face. Preferably, each end stop is configured as a torque generator either.

The protrusion may comprise a magnetizable material and the force generator may comprise a magnetic field generator for generating a magnetic field subjecting the protrusion to a driving force. For instance, the protrusion may comprise a ferromagnetic material or a paramagnetic material or consist thereof. The magnetic field generator may comprise a coil and a pole piece supporting the coil.

Preferably, the force generator comprises two solenoids being arranged at a distance from each other with the protrusion in between, wherein each solenoid has at least one pole piece providing or supporting an end stop. The force generator comprises two magnets, e.g. two pot magnets, each magnet having a solenoid.

The rotational axis may extend parallel, preferably collinear to the translational axis. These relative orientations of the rotational axis and the translational axis result in a very symmetric, simple and compact geometric structure of the actuating device.

The invention further provides a method for operating an actuating device for a camshaft timing apparatus.

The method suits an actuating device with a movable actuating member which defines a translational axis being supported displaceable along the translational axis and defines a rotational axis being supported rotatable about the rotational axis. The actuating device may have a force generator for generating a force driving the actuating member along the translational axis and a torque generator for subjecting the actuating member to a torque about the rotational axis. Correspondingly, the method may be applied to an actuating device according to the invention as described above.

The torque generated by the torque generator can be varied by varying the driving force generated by the force generator. Thus, the force generator is exploited twice. The driving force generated by the force generator is used not only to provide an axial displacement of the actuating member but also to control the torque applied the actuating member. The double functionality of the force generator results in a compact, structurally simple and economic actuating device.

The force generator may generate a magnetic field by means of a magnetic field generator comprising at least one solenoid for subjecting the actuating member comprising a magnetizable material to a magnetic force wherein particularly an average strength of the magnetic force may be varied by varying a strength of a continuous directed electric current and/or a width-ratio of a pulse modulated directed electric current flowing through the at least one solenoid. Pulse modulation of a directed electric current means alternately switching on and off the directed electric current. Correspondingly, the magnetic field alternately grows and vanishes and, thus, the magnetic force applied to the actuating member also grows and vanishes alternately. A variation of the width-ration of the pulse modulation, hence, provides a corresponding variation of the timely averaged force applied to the actuating member.

Furthermore, the invention provides a system comprising a camshaft timing apparatus and an actuating device.

The camshaft timing apparatus may have a valve actuator defining a translational axis and being axially displaceable along the translational axis and a torque transmitter defining a rotational axis and being rotatable about the rotational axis. Camshaft timing apparatuses comprise both a hydraulic motor, a hydraulic pump and a valve controlling the flow of a hydraulic fluid between the hydraulic pump and the hydraulic motor. The camshaft timing apparatus may be highly integrated.

The actuation device may have a movable actuating member, the actuating member defining a translational axis and being supported displaceable along the translational axis, and a force generator for generating a force driving the actuating member along the translational axis, wherein the actuating member of the actuating device is thrust-proof and tension-proof connectable or connected to the valve actuator of the camshaft timing apparatus in the mounted state of the system. In this configuration the actuating member of the actuating device and the valve actuator of the camshaft timing apparatus have a collinear orientation such that each translation of the actuating member results in an identical translation of the valve actuator.

The actuating member can define a rotational axis and is supported rotatable about the rotational axis wherein the actuating device comprises a torque generator for subjecting the actuating member to a torque about the rotational axis, wherein the actuating member of the actuating device is torque-proof connected to the torque transmitter of the camshaft timing apparatus in the mounted state of the system. In this configuration the actuating member of the actuating device and the valve actuator of the camshaft timing apparatus have again a collinear orientation such that each rotation of the actuating member results in an identical rotation of the valve actuator.

The system may comprise an actuating device according to the invention. Of course, the actuating device may have any further feature described above.

Furthermore, the invention provides a method for operating a system comprising a camshaft timing apparatus and an actuating device for a camshaft timing apparatus. Preferably a system according to the invention is operated. The method is best suited for a system comprising a camshaft timing apparatus as described above and an actuating device according to the invention. However, the method may be applied to similar systems mutatis mutandis.

The method may comprise the step of actuating a valve of the camshaft timing apparatus by means of the actuating device, the actuating device displacing a valve actuator of the valve along a translational axis, the valve controlling a connection between a hydraulic pump of the camshaft timing apparatus and a hydraulic motor of the camshaft timing apparatus, the hydraulic motor being coupled to a crankshaft and a camshaft and being configured for adjusting an angular position of the camshaft relative to the crankshaft. By actuating the valve an angular relation between the camshaft and the crankshaft can be adjusted such that an operation of an engine comprising the system is optimized with respect to a driving power and/or an efficiency, particularly a car engine.

The method may further comprise the step of actuating the hydraulic pump by providing a rotation of a rotor of the hydraulic pump about a rotational axis relative to the camshaft. The hydraulic pump is driven by the camshaft instead of an additional separate drive.

The method comprises the step of controlling the rotational speed of the rotor relative to the camshaft by means of the actuating device, the actuating device subjecting the rotor to a variable torque about the rotational axis. The torque transmitter of the camshaft timing apparatus, thus, may rotate relative to the stationary part of the engine. The rotational speed of the torque transmitter relative to the stationary part may be varied by the actuating device between no rotation at all, i.e. a maximum rotational speed relative to the camshaft, and the rotational speed of the camshaft, i.e. no rotational speed relative to the camshaft.

In other words, the performance of the hydraulic pump coupled to the torque transmitter may be continuously varied between a maximum pumping power and no pumping at all. On the one hand, this allows for the hydraulic pump to be switched off when no camshaft timing adjustment is required. On the other hand, the hydraulic pump may be operated at an adequate, i.e. low and sufficient pumping power independently from an actual rotational speed of the camshaft when a camshaft timing adjustment is required. This flexibility in controlling the camshaft timing apparatus allows for significantly reducing the energy loss caused thereby and, hence, increases the driving power and the efficiency of the engine.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
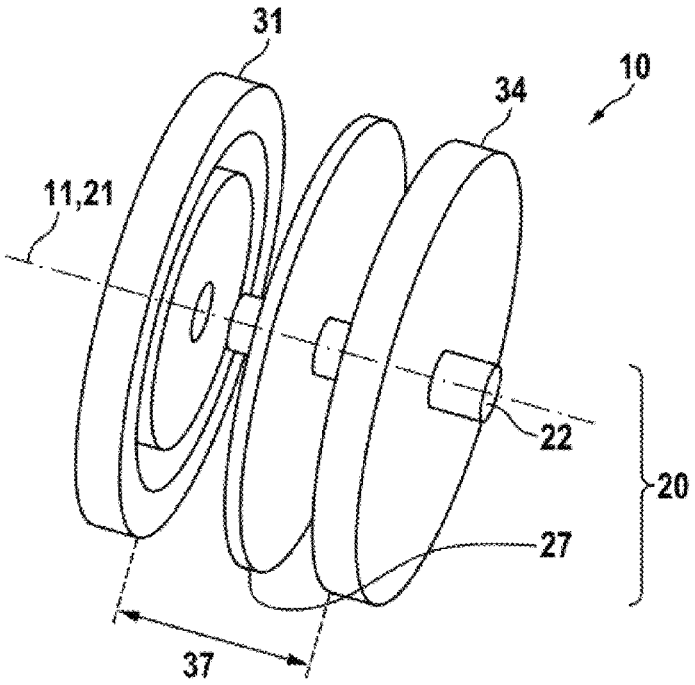
FIG. 1 shows a perspective explosion view of an actuating device according to the invention.
Figure 2:
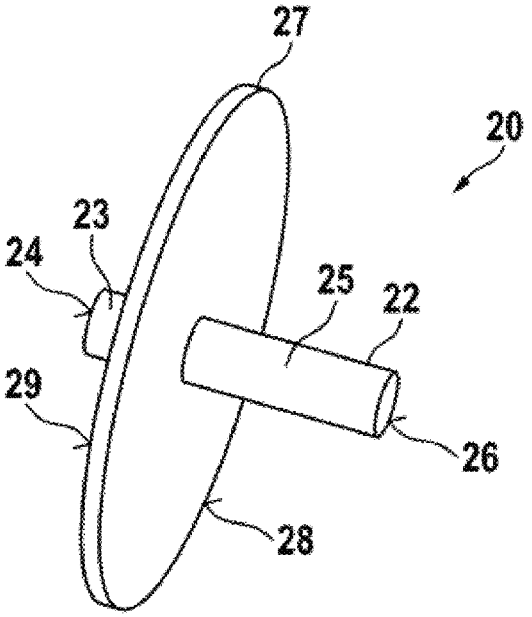
FIG. 2 shows a perspective view of the actuating member of the actuating device shown in FIG. 1.
Figure 3:
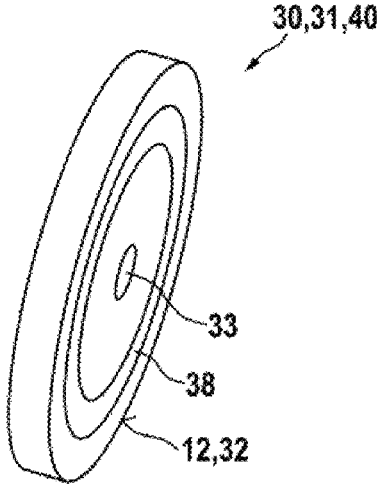
FIG. 3 shows a perspective view of a first end stop of the actuating device shown in FIG. 1.
Figure 4:
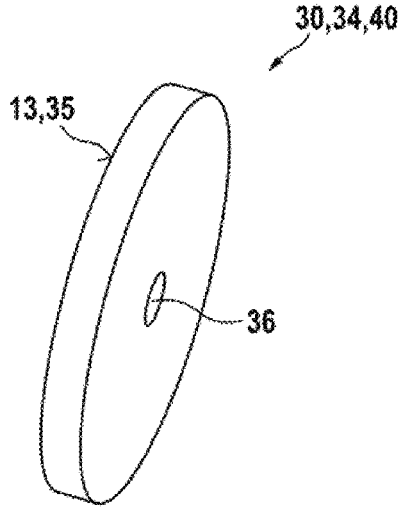
FIG. 4 shows a perspective view of a second end stop of the actuating device shown in FIG. 1.

In FIGS. 1 to 4 an exemplary embodiment of an actuating device 10 for a camshaft timing apparatus 50 according to the invention is shown. The actuating device 10 comprises a movable actuating member 20 being supported displaceable along a translational axis 11 and rotatable about a rotational axis 21. In this example, the rotational axis 21 is identical with, i.e. extends collinear to the translational axis 11, however other relative orientations are not excluded.

The actuating member 20 comprises a shaft 22 which may comprise an elongate cylindrical rod extending along the translational axis 11 and a protrusion 27 being tension-proof, thrust-proof and torque-proof connected to the shaft 22. The protrusion 27 may be integral with the shaft 20, as depicted, and may comprise a magnetizable material, i.e. a paramagnetic material. The protrusion 27 may be a circular disc extending perpendicular to the shaft 22 and may be arranged eccentric between opposite axial free ends 24, 26 of the shaft 22, thus dividing the shaft 22 into a shorter section 23 and a longer section 25. In other embodiments the protrusion may be centered, as well.

The actuating device 10 further comprises a force generator 30 for generating a force driving the actuating member 20 along the translational axis 11. The force generator 30 may have a magnetic field generator for generating a magnetic field subjecting the protrusion 27 to a driving force. The magnetic field generator has two pot magnets. The pot magnets each may comprise a solenoid 31, 34 for generating a magnetic field and are arranged at a distance 37 from each other with the protrusion 27 in between, wherein each solenoid 31, 34 has a pole piece providing an axially fixed end stop 12, 13 to the protrusion 27.

The end stops 12, 13, thus, are arranged at the distance 37 from each other and encompass and face the protrusion 27. Each end stop 12, 13 has a central bore 33, 36 which the shaft 22 of the actuating member 20 may extend through. The end stops 12, 13 define a first axial position and a second axial position of the protrusion 27 abutting the respective end stop 12, 13. The actuating device 10 has a restorer which may be a spring or the like for restoring a central axial position of the protrusion 27 between the end stops 12, 13 thus defining a third axial position of the protrusion 27 between the first axial position and the second axial position.

Furthermore, the actuating device 10 comprises an axially fixed torque generator 40 for subjecting the actuating member 20 to a torque about the rotational axis 21. The torque generator 40 and the protrusion 27 may comprise axial faces 28, 29, 32, 35, respectively. The axial faces 28, 29, 32, 35 face each other providing a rotational resistance to the protrusion 27 abutting the torque generator 40 if forced against each other. The torque generator 40 may optionally comprise friction pads 38 which can be attached to or be integrated in the respective axial face 32, 35.

Figure 5:
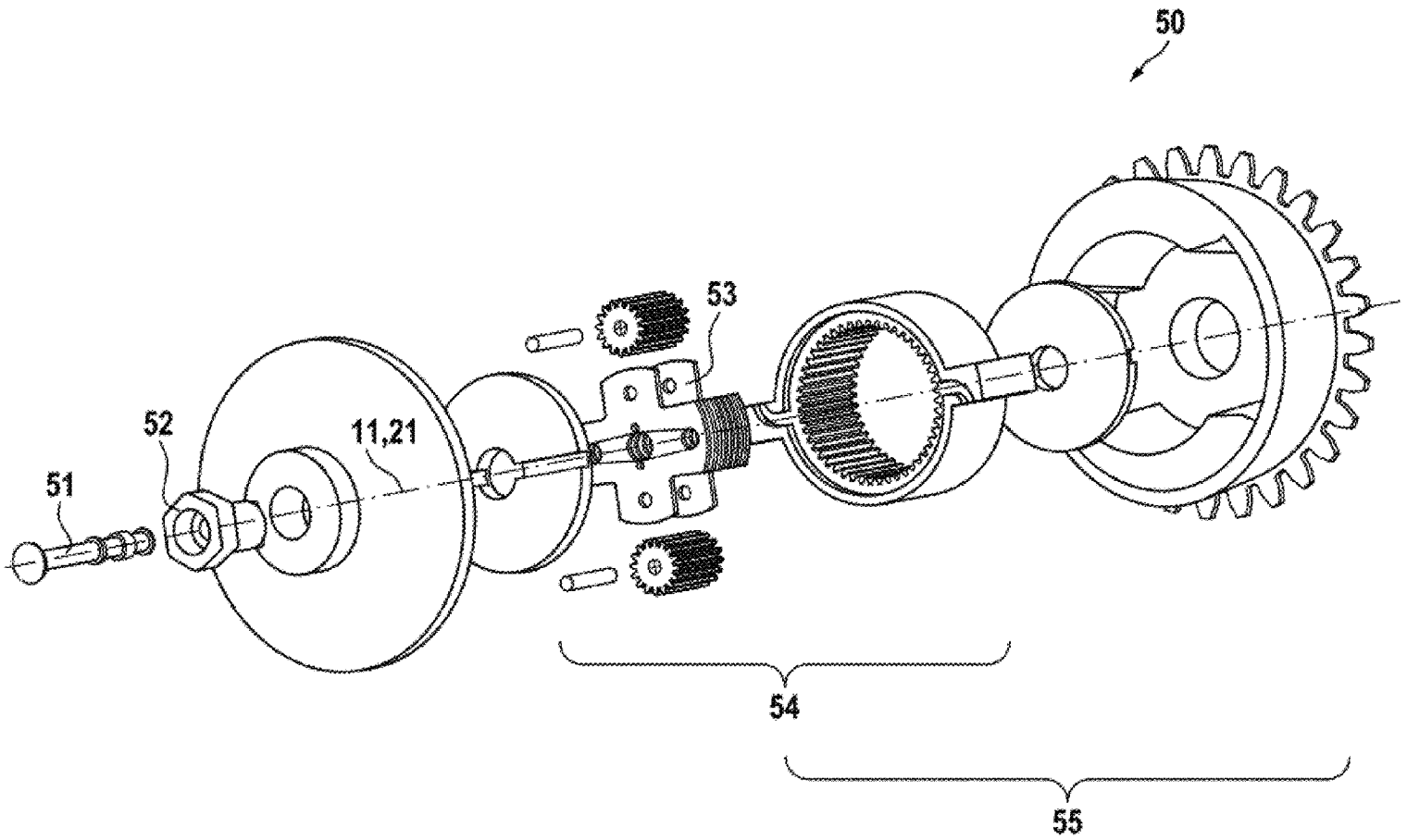
FIG. 5 shows a perspective explosion view of a camshaft timing apparatus of a system according to the invention.

In FIG. 5 a camshaft timing apparatus 50 of a preferred embodiment of a system according to the invention is shown. The camshaft timing apparatus is similar to the camshaft timing apparatuses described in PCT/EP2017/069942 and PCT/EP2017/069960 which are incorporated as fully disclosed herein. The camshaft timing apparatus 50 comprises a hydraulic motor 55 and a hydraulic pump 54 which both are integrated in the camshaft timing apparatus 50. The hydraulic motor 55 may be coupled to a crankshaft, e.g. via a belt drive or a gear, and a camshaft, e.g. via a flange or some other coupling and is configured for adjusting an angular position of the camshaft relative to the crankshaft. The hydraulic pump 54 has a rotor 53 and a torque transmitter 52 being torque-proof connected thereto.

The rotor 53 has an integrated valve (not visible) fluidly connecting the hydraulic pump 54 to the hydraulic motor 55. The valve controls a connection between the hydraulic pump 54 of the camshaft timing apparatus 50 and the hydraulic motor 55 of the camshaft timing apparatus 50. The valve comprises a valve actuator 51 which may be configured as an elongate needle, as depicted. The valve actuator 51 extends through the torque transmitter 52 and the rotor 53 and is supported axially displaceable in corresponding cylindric bores of the torque transmitter 52 and the rotor 53, respectively. The needle has three axial positions: a first position in which the valve fluidly connects the hydraulic pump 54 with the hydraulic motor 55 to drive the hydraulic motor 55 in a first rotational direction. In a second position of the needle the valve fluidly connects the hydraulic pump 54 with the hydraulic motor 55 to drive the hydraulic motor 55 in a second rotational direction, being opposite to the first rotational direction. In the third, neutral position, the valve fluidly disconnects the hydraulic pump 54 and the hydraulic motor 55 and an inlet port of the hydraulic motor 55 and an outlet port of the hydraulic motor 55 are fluidly disconnected as well, to thereby block a rotor of the hydraulic motor 55 relative to a stator or the hydraulic motor 55.

During operation of the system the valve of the camshaft timing apparatus 50 is actuated by means of the actuating device 10. The actuating device 10 displaces the valve actuator 51 of the valve along the translational axis 11 in order to realize axial positions of the valve actuator 51 depending on actual adjustment requirements. A first axial position of the valve actuator 51, e.t. the needle, corresponds to a first valve state which causes the hydraulic motor 55 to set ahead the camshaft relative to the crankshaft. A second axial position of the valve actuator 51, e.g. the needle, corresponds to a second valve state which causes the hydraulic motor 55 to set back the camshaft relative to the crankshaft. A third axial position of the valve actuator 51, e.g. the needle, causes a halt of the hydraulic motor 55 to keep the angular relation between the camshaft and the crankshaft constant.

The hydraulic pump 54 of the camshaft timing apparatus 50 is actuated by providing a rotation of the rotor 53 of the hydraulic pump 54 about the rotational axis 21 relative to the camshaft. The rotational speed of the rotor 53 relative to the camshaft is controlled by the actuating device 10, the actuating device 10 subjecting the rotor 53 to a variable torque about the rotational axis 21.

The variable torque is generated by the torque generator 40 as a frictional force and is varied by varying the magnetic force generated by the force generator 30. The magnetic force depends of the magnetic field generated by the solenoids 31, 34 and is varied by varying an average strength of a continuous directed electric current and/or a width-ratio of a pulse modulated directed electric current flowing through the solenoids 31, 34.

In particular, no torque is applied to the torque transmitter 52 in the third valve state while in the first valve state and in the second valve state the torque applied to the torque transmitter 52 is adjusted to be adequate for driving the hydraulic motor 55.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. An actuating device for a camshaft timing apparatus, the actuating device comprising:

a movable actuating member being supported displaceable along a translational axis, the actuating member being supported rotatable about a rotational axis;

a force generator to generating a force driving the actuating member along the translational axis; and a torque generator to subject the actuating member to a torque about the rotational axis, wherein the actuating member comprises a shaft extending along the translational axis and a protrusion extending transverse to the shaft and being tension-proof and thrust-proof connected to the shaft, wherein the actuating device comprises two end stops being arranged at a distance from each other with the protrusion in between thus defining a first axial position and a second axial position of the protrusion, and wherein each of the two end stops has a central bore, the shaft of the actuating member extending through the central bore of each of the two end stops.

2. The actuating device according to claim 1, wherein the actuating device comprises a restorer for restoring an axial position of the protrusion between the two end stops, thus defining a third axial position of the protrusion between the first axial position and the second axial position.

3. The actuating device according to claim 1, wherein the torque generator is axially fixed and the protrusion is torque-proof connected to the shaft, wherein the torque generator and the protrusion each comprise an axial face, the axial faces facing each other providing a rotational resistance to the protrusion abutting the torque generator if forced against each other.

4. The actuating device according to claim 1, wherein the protrusion comprises a magnetizable material and the force generator comprises a magnetic field generator for generating a magnetic field subjecting the protrusion to a driving force.

5. The actuating device according to claim 4, wherein the force generator comprises two solenoids being arranged at a distance from each other with the protrusion in between, wherein each of the two solenoids has at least one pole piece providing or supporting one of the two end stops.

6. The actuating device according to claim 1, wherein the rotational axis extends parallel or collinear to the translational axis.

7. A method for operating an actuating device for a camshaft timing apparatus, the method comprising:

providing the actuating device with a movable actuating member defining a translational axis and being supported displaceable along the translational axis; and defining a rotational axis and supporting the movable actuating member rotatable about the rotational axis;

generating a force via a force generator to drive the actuating member along the translational axis; and subjecting the actuating member to a torque, via a torque generator, about the rotational axis, and varying the torque generated by the torque generator by varying the driving force generated by the force generator, wherein the actuating member comprises a shaft extending along the translational axis and a protrusion extending transverse to the shaft and being tension-proof and thrust-proof connected to the shaft, wherein the actuating device comprises two end stops being arranged at a distance from each other with the protrusion in between thus defining a first axial position and a second axial position of the protrusion, and wherein each of the two end stops has a central bore, the shaft of the actuating member extending through the central bore of each of the two end stops.

8. The method according to claim 7, wherein the force generator generates a magnetic field via a magnetic field generator comprising at least one solenoid for subjecting the actuating member comprising a magnetizable material to a magnetic force wherein an average strength of the magnetic force is varied by varying a strength of a continuous directed electric current and/or a width-ratio of a pulse modulated directed electric current flowing through the at least one solenoid.

9. A system comprising:

a camshaft timing apparatus having a valve actuator defining a translational axis and being axially displaceable along the translational axis and a torque transmitter defining a rotational axis and being rotatable about the rotational axis;

an actuating device having a movable actuating member, the actuating member defining the translational axis and being supported displaceable along the translational axis, and a force generator to generate a force driving the actuating member along the translational axis, wherein the actuating member of the actuating device is thrust-proof and tension-proof connectable or connected to the valve actuator of the camshaft timing apparatus in the mounted state of the system, wherein the actuating member defines the rotational axis and is supported rotatable about the rotational axis, wherein the actuating device comprises a torque generator for subjecting the actuating member to a torque about the rotational axis, and wherein the actuating member of the actuating device is torque-proof connected to the torque transmitter of the camshaft timing apparatus in the mounted state of the system.

10. The system according to claim 9, wherein the actuating member comprises a shaft extending along the translational axis.

11. A method for operating a system comprising a camshaft timing apparatus and an actuating device for a camshaft timing apparatus according to claim 9, the method comprising:

actuating a valve of the camshaft timing apparatus by the actuating device, the actuating device displacing the valve actuator of the valve along a translational axis, the valve controlling a connection between a hydraulic pump of the camshaft timing apparatus and a hydraulic motor of the camshaft timing apparatus, the hydraulic motor being coupled to a crankshaft and a camshaft and being configured for adjusting an angular position of the camshaft relative to the crankshaft;

actuating the hydraulic pump by providing a rotation of a rotor of the hydraulic pump about the rotational axis relative to the camshaft; and controlling the rotational speed of the rotor relative to the camshaft by the actuating device, the actuating device subjecting the rotor to a variable torque about the rotational axis.

* * * * *